US005454353A

United States Patent [19]

Elendt et al.

[11] Patent Number: 5,454,353

[45] Date of Patent: Oct. 3, 1995

[54] TAPPET WITH ANTI-ROTATION DEVICE

[75] Inventors: Harald Elendt, Wilhelmsdorf; Christof Faria, Herzogenaurach; Gerald Fischer, Höchstadt/Aisch; Michael Haas, Aurachtal; Harald Elendt, Wilhelmsdorf; Christof Faria, Herzogenaurach; Gerald Fischer, Höchstadt/Aisch; Michael Haas, Aurachtal; Gerhard Maas, Herzogenaurach, all of Germany

[73] Assignee: Ina Walzlager Schaeffler KG, Germany

[21] Appl. No.: 182,592

[22] Filed: Jan. 18, 1994

[30] Foreign Application Priority Data

Feb. 2, 1993 [DE] Germany ..... 43 02 877.2

[51] Int. Cl.[6] ..... F01L 1/14; F01L 1/16; F01L 1/24

[52] U.S. Cl. ..... 123/90.16; 123/90.5

[58] Field of Search ..... 123/90.15, 90.16, 123/90.48, 90.5, 90.51, 90.55

[56] References Cited

U.S. PATENT DOCUMENTS

| | | | |
|---|---|---|---|
| 4,869,215 | 9/1989 | Parsons | 123/90.48 |
| 4,876,994 | 10/1989 | Speil et al. | 123/90.5 |
| 4,885,952 | 12/1989 | Connell | 123/90.16 |
| 4,905,639 | 3/1990 | Konno | 123/90.16 |
| 4,909,198 | 3/1990 | Shiraya et al. | 123/90.51 |
| 4,995,353 | 2/1991 | Stegeman et al. | 123/90.48 |
| 5,090,364 | 2/1992 | McCarroll et al. | 123/90.16 |
| 5,193,496 | 3/1993 | Kruger | 123/90.16 |
| 5,253,621 | 10/1993 | Dopson et al. | 123/90.16 |
| 5,287,830 | 2/1994 | Dopson et al. | 123/90.16 |

*Primary Examiner*—Henry C. Yuen
*Assistant Examiner*—Weilun Lo
*Attorney, Agent, or Firm*—Bierman and Muserlian

[57] ABSTRACT

A tappet (1) for a valve operating mechanism for an internal combustion engine comprising a thin-walled jacket (3) guided in a bore (5) of a cylinder head (6) and provided in the cam direction with a circular ring-shaped bottom (4) which surrounds a circular bottom (16) of a concentrically arranged guide sleeve (7) in whose bore (9) a clearance compensation element (10) is arranged for longitudinal displacement, the jacket (3) comprising the circular ring-shaped bottom (4) and the guide sleeve (7) comprising the circular bottom (16) being engageable by cams of differing pitch and relatively displaceable axially with respect to each other and with respect to the bore (5) of the cylinder head (6), and a first, central cam (14) of smaller pitch and at least one cam (15) of larger pitch selectively engaging the circular bottom (16) and the circular ring-shaped bottom (4) respectively, characterized in that means are arranged in the jacket (3) which prevent an axial rotation of the tappet (1) in the bore (5) of the cylinder head (6) and at the same time also prevent an axial rotation of the guide sleeve (7) which is arranged concentrically in the tappet (1) and in whose bore the clearance compensation element (10) is mounted for longitudinal displacement, at least one axially acting pressure spring (22) being arranged between the circular ring-shaped bottom (4) and a radial flange (12) which projects from the guide sleeve (7) and is guided on an inner peripheral surface (13) of the jacket (3).

7 Claims, 1 Drawing Sheet

TAPPET WITH ANTI-ROTATION DEVICE

STATE OF THE ART

Figure 1:
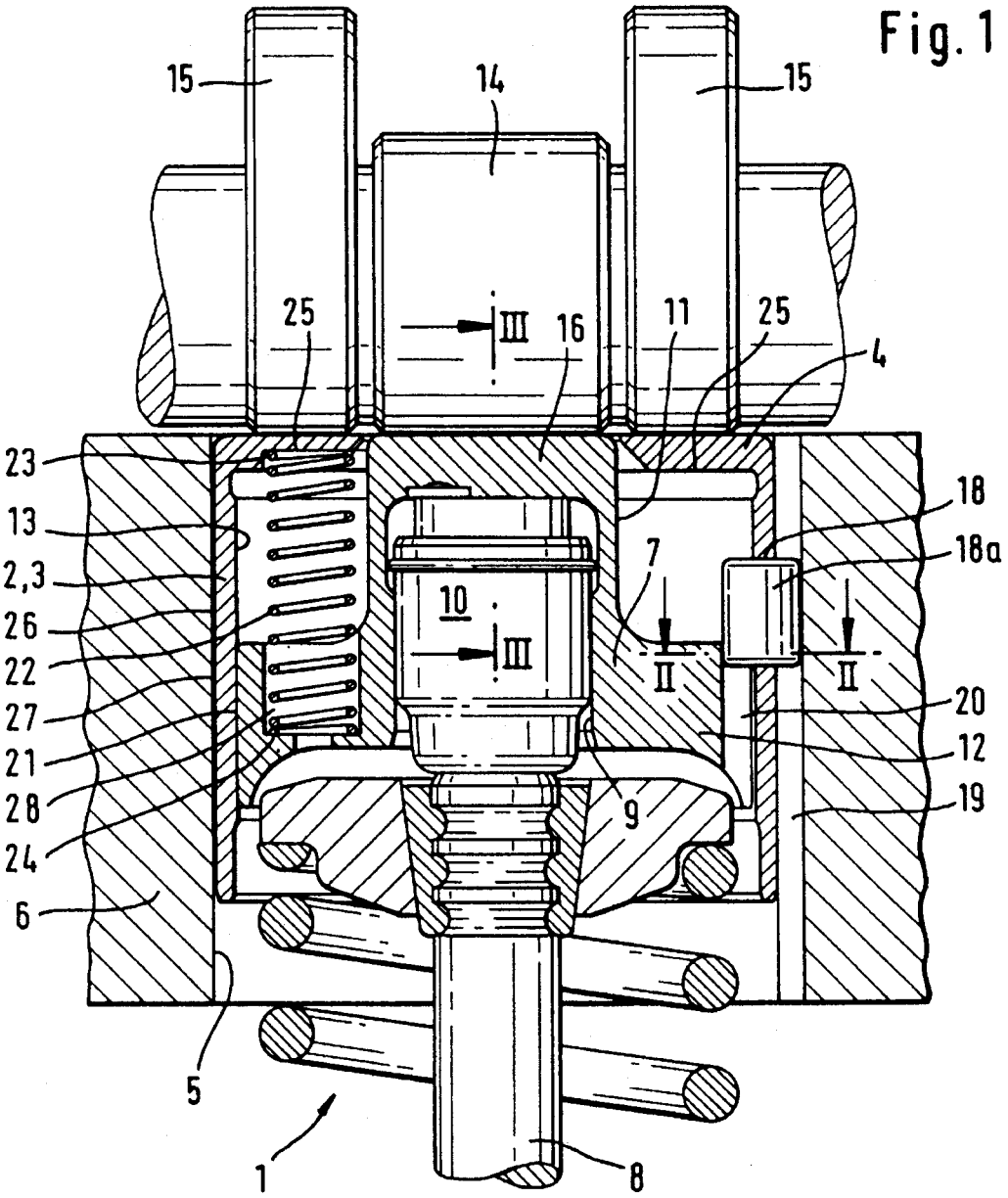

A tappet for a valve operating mechanism for internal combustion engines comprising a thin-walled jacket guided in a bore of a cylinder head and provided in the cam direction with a circular ring-shaped bottom which surrounds a circular bottom of a concentrically arranged guide sleeve in whose bore a clearance compensation element is arranged for longitudinal displacement, the jacket comprising the circular ring-shaped bottom and the guide sleeve comprising the circular bottom being engageable by cams of differing pitch and relatively displaceable axially with respect to each other and with respect to the bore of the cylinder head, and a first, central cam of smaller pitch and at least one cam of larger pitch selectively engaging the circular bottom and the circular ring-shaped bottom respectively is known from DE-OS 42 06 166 and comprises a two-part housing whose bottom is engageable by at least two cams having different lifting curves. The two housing parts are coupled with each other by means of radially acting pistons comprising pins. In the uncoupled state, the outer housing part executes an idling stroke and the valve remains closed.

A disadvantage of a tappet of this type is that only a limited contact surface is available on the bottom of the housing for the outer cam for actuating the outer housing part. In the most unfavorable case, a result of this can be that the engaging surface of the cam travels beyond the tappet edge so that only an insufficient valve lift is possible. To assure the required surface on the tappet bottom during the travel of the cam and thus obtain the desired valve lift curve, it would be desirable for the bottom to have a cylindrical shape as seen in the direction of the cam. This would necessitate a simple anti-rotation device for the tappet housing in the bore of the cylinder head and an anti-rotation device between the two parts of the housing, but the State of the Art contains no indications of such a device.

OBJECTS OF THE INVENTION

It is an object of the invention to provide a switchable tappet of the type initially described which avoids the mentioned disadvantages and possesses an anti-rotation device of simple structure for the tappet itself and for the inner components of the tappet.

THE INVENTION

The novel tappet of the invention for a valve operating mechanism for an internal combustion engine comprising a thin-walled jacket (3) guided in a bore (5) of a cylinder head (6) and provided in the cam direction with a circular ring-shaped bottom (4) which surrounds a circular bottom (16) of a concentrically arranged guide sleeve (7) in whose bore (9) a clearance compensation element (10) is arranged for longitudinal displacement, the jacket (3) comprising the circular ring-shaped bottom (4) and the guide sleeve (7) comprising the circular bottom (16) being engageable by cams of differing pitch and relatively displaceable axially with respect to each other and with respect to the bore (5) of the cylinder head (6), and a first, central cam (14) of smaller pitch and at least one cam (15) of larger pitch selectively engaging the circular bottom (16) and the circular ring-shaped bottom (4) respectively, is characterized in that means are arranged in the jacket (3) which prevent an axial rotation of the tappet (1) in the bore (5) of the cylinder head (6) and at the same time also prevent an axial rotation of the guide sleeve (7) which is arranged concentrically in the tappet (1) and in whose bore the clearance compensation element (10) is mounted for longitudinal displacement, at least one axially acting pressure spring (22) being arranged between the circular ring-shaped bottom (4) and a radial flange (12) which projects from the guide sleeve (7) and is guided on an inner peripheral surface (13) of the jacket (3).

Means are arranged in the jacket which prevent an axial rotation of the tappet in the bore of the cylinder head and at the same time also prevent an axial rotation of a guide sleeve which is arranged concentrically in the tappet and in whose bore, the clearance compensation element is mounted for longitudinal displacement, at least one axially acting pressure spring being arranged between the circular ring-shaped bottom and a radial flange which projects from the guide sleeve and is guided on an inner peripheral surface of the jacket. By reason of this construction, complicated modifications on already fabricated cylinder heads are not required. The cross-section of the jacket of the housing is only slightly weakened and at the same time, further measures complicated from the construction and manufacturing point of view, for the positional fixing of the guide sleeve or a similar element in the tappet can be dispensed with.

The fact that the tappet is secure against rotation offers advantageous possibilities to the engineer for designing the surfaces of the bottoms which are in contact with the respective contacting surfaces of the cams. An example of such a design is obtained by providing the bottom of the housing and/or the bottom of the guide sleeve with a cylindrical configuration as seen in the cam direction.

Due to the fact that the tappet is made switchable especially with a view to multi-valve technics, the possibility exists particularly in the idling and part load operating modes of the internal combustion engine, to shut down at least one inlet and/or outlet valve or to operate with only a small opening cross-section of the engine valves. Tests have shown that in the aforementioned operating states of the internal combustion engine, it is advantageous to open only one control valve completely and thus exert a generally favorable influence on carburation and combustion by the swirl produced in the combustion chamber. The higher admission rates resulting from the smaller opening cross-sections accompanied by correspondingly lower pressures can further lead to an improved diffusion and vaporization of the mixture. These effects in turn have a positive influence on fuel consumption and pollutant emission.

The means arranged in the jacket comprise at least one cylindrical element such as a roller needle whose diameter is larger than the wall thickness of the jacket and which is arranged parallel to a longitudinal axis of the tappet and fixed in a recess of the jacket. A longitudinal axis of the roller needle extends approximately centrically in the recess and the roller needle engages into a longitudinally extending guide groove in an outer peripheral surface of the peripheral flange of the guide sleeve. Since the roller needle has only small dimensions, the cross-section of the jacket is only slightly weakened by the required recess. In exceptional cases, several such anti-rotation devices can be provided in each tappet, or separate devices can be provided to prevent rotation of the housing in the bore of the cylinder head and rotation of the guide sleeve in the tappet. It is also conceivable to use other kinds of rotation-preventing means such as pins, springs etc. Because the roller needle engages into the longitudinally extending groove in the flange and at the same time into the guide groove in the cylinder head, the initially described anti-rotation device is realized in a relatively simple manner and further measures for fixing the elements in the peripheral direction can be dispensed with.

The pressure spring is inserted into a bore of the flange, which bore is open towards the bottom. This pressure spring assures a permanent contact of the housing bottom with its actuating cam and the underside of the bottom comprises a similar means in the form of a cavity for receiving the pressure spring. The bore and the cavity serve to fix the pressure spring in its position in a simple manner.

The bottom of the guide sleeve, the bottom of the housing and/or the outer peripheral surface of the jacket are provided with a wear-resistant coating. By this protective coating e.g. a sprayed ceramic layer, premature wear of the tappet can be avoided without a substantially higher total mass.

The guide sleeve and/or the housing are advantageously made of a light-weight material such as aluminium. This embodiment contributes to reducing the total mass of the tappet and thus also to minimizing the oscillating masses in the valve operating mechanism.

The bottom of the housing and/or the bottom of the guide sleeve have a cylindrical configuration as seen in the cam direction. By this measure in conjunction with an optimum choice of the cam geometry and especially of its running path, it is possible to obtain the desired valve lift curves despite the small cam contact surface on the bottom, particularly on the bottom of the housing.

Figure 3:
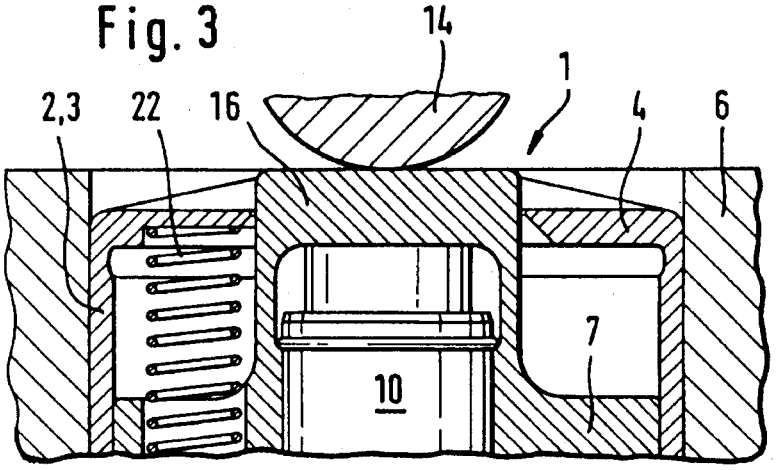
Figure 2:
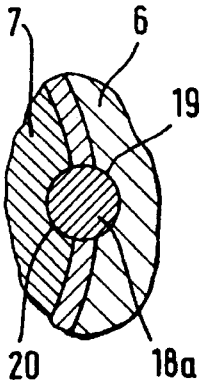

Referring now to the drawings:

FIG. 1 is a cross-section of a tappet of the invention in the installed state, FIG. 2 is a cross-section along line II—II of FIG. 1 and FIG. 3 is a partial view of a cross-section along line III—III of FIG. 1.

FIG. 1 shows a tappet 1 of the invention having a hollow cylindrical housing 2 comprising a cup-shaped jacket 3 and a circular ring-shaped bottom 4. The tappet 1 slides in a bore 5 of a cylinder head 6, only roughly indicated, by means of the jacket 3. A guide sleeve 7 comprising a bore 9 facing a valve stem 8 is arranged concentrically within the housing 2. An only roughly represented hydraulic clearance compensation element 10 is arranged axially displaceable in this bore 9. A peripheral flange 12 extends in a radial direction from an outer peripheral surface 11 of the guide sleeve 7 and is supported on an inner peripheral surface 13 of the jacket 3. The guide sleeve 7 and the housing 2 are configured so that they can be engaged by cams 14, 15 of differing pitch, a circular bottom 16 of the guide sleeve 7 being engaged by a first, central cam 14 of smaller pitch, and the circular ring-shaped bottom 4 of the housing 2 being engaged by two cams 15 of larger pitch.

The guide sleeve 7 and the housing 2 are relatively displaceable axially with respect to each other and with respect to the bore 5 of the cylinder head 6. The outer peripheral surface 11 of the guide sleeve 7 is surrounded in the region of the bottom 16 by the bottom 4 of the housing 2. A roller needle **18*a* fixed in a recess 18 of the jacket 3 of the housing 2 serves as a device against axial rotation of the housing 2 in the bore 5 of the cylinder head and at the same time against axial rotation of the guide sleeve 7 in the interior of the housing 2. To prevent rotation, the roller needle 18*a* engages on one side into a longitudinally extending guide groove 19 in the bore 5 of the cylinder head 6, and on the other side, the roller needle 18*a* is disposed in a further guide groove 20 located in an outer peripheral surface 21 of the flange 12 of the guide sleeve 7**.

The ends 23, 24 of a pressure spring 22 act on an underside 25 of the bottom 4 of the housing 2 and at the same time on the flange 12 of the guide sleeve 7 thus pushing these parts axially apart. As roughly indicated in the drawing, it is possible to provide a wear-resistant coating 27 on the outer peripheral surface 26 of the jacket 3.

A closer description of the structure and method of functioning of the tappet concerned is not given here as it is well known to persons skilled in the art.

FIG. 2 shows a cross-section along line II—II of FIG. 1 to better illustrate the arrangement of the anti-rotation device in the form of the roller needle **18*a* which engages on one side into the guide groove 19 in the cylinder head 6 and the other side into a further guide groove 20 in the guide sleeve 7. From FIG. 3, it can be seen that the bottom 4 of the housing 2 has a cylindrical configuration as seen in the cam direction along the cam shaft axis. By this, it is possible to obtain the desired valve lift curves despite the small cam contact surface available on the bottom 4**.

Various modifications of the tappet of the invention may be made without departing from the spirit or scope thereof and it is to be understood that the invention is intended to be limited only as defined in the appended claims.

What we claim is:

1. A tappet (1) for a valve operating mechanism for an internal combustion engine comprising a cylindrical housing comprising a thin-walled jacket (3) guided in a bore (5) of a cylinder head (6) and with a circular ring-shaped bottom (4) which surrounds a circular bottom (16) of a concentrically arranged guide sleeve (7) in whose bore (9) a clearance compensation element (10) is arranged for longitudinal displacement, the jacket (3) comprising the circular ring-shaped bottom (4) and the guide sleeve (7) comprising the circular bottom (16) being engageable by cams of differing pitch and relatively displaceable axially with respect to each other and with respect to the bore (5) of the cylinder head (6), and a first, central cam (14) of smaller pitch and at least one cam (15) of larger pitch selectively engaging the circular bottom (16) and the circular ring-shaped bottom (4) respectively, characterized in that a means is arranged in the jacket (3) which prevents an axial rotation of the tappet (1) in the bore (5) of the cylinder head (6) and at the same time also prevents an axial rotation of the guide sleeve (7), at least one axially acting pressure spring (22) being arranged between the circular ring-shaped bottom (4) and a peripheral flange (12) which projects from the guide sleeve (7) and is guided on an inner peripheral surface (13) of the jacket (3).

2. A tappet of claim 1 wherein the means arranged in the jacket (3) comprise at least one cylindrical element such as a roller needle (**18*a*) whose diameter is larger than the wall thickness of the jacket (3) and which is arranged parallel to a longitudinal axis of the tappet (1) and is fixed in a recess (18) of the jacket (3), a longitudinal axis of the roller needle (18*a*) extends approximately centrically in the recess (18) and the roller needle (18*a*) engages into a longitudinally extending guide groove (20) in an outer peripheral surface (21) of the peripheral flange (12) of the guide sleeve (7**).

3. A tappet of claim 1 wherein the pressure spring (22) is inserted into a bore (28) of the flange (12), the bore (28) is open towards the ring-shaped bottom (4).

4. A tappet of claim 1 wherein the bottom (16) of the guide sleeve (7), the bottom (4) of the housing (2) or the outer peripheral surface (26) of the jacket (3) is provided with a wear-resistant coating (27).

5. A tappet of claim 1 wherein the guide sleeve (7) or the housing (2) is made of a light-weight material.

6. A tappet of claim 4 wherein the guide sleeve (7) or the housing (2) is made of a light-weight material.

7. A tappet of claim 6 wherein the light-weight material is aluminium.

* * * * *